US008480815B2

(12) United States Patent
Wang

(10) Patent No.: US 8,480,815 B2
(45) Date of Patent: Jul. 9, 2013

(54) METHOD OF MAKING ND-FE-B SINTERED MAGNETS WITH DY OR TB

(75) Inventor: Yucong Wang, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 58 days.

(21) Appl. No.: 13/007,203

(22) Filed: Jan. 14, 2011

(65) Prior Publication Data

US 2012/0182102 A1 Jul. 19, 2012

(51) Int. Cl.

| | |
|---|---|
| ***H01F 1/03*** | (2006.01) |
| ***H01F 7/02*** | (2006.01) |
| ***B22F 1/00*** | (2006.01) |
| ***B22F 3/24*** | (2006.01) |

(52) U.S. Cl.
USPC ..... 148/101; 335/302; 419/64; 419/28

(58) Field of Classification Search
USPC ..... 427/127; 148/101; 335/302; 419/64, 419/28
See application file for complete search history.

(56) References Cited

U.S. PATENT DOCUMENTS 7,632,630 B2 * 12/2009 Mori et al. ..... 430/326

FOREIGN PATENT DOCUMENTS

JP 2001279090 A 10/2001
JP 2006249456 A 9/2006

OTHER PUBLICATIONS

Plusa, et al., Domain Structure and Domain-Wall Energy in Polycrystalline R2Fe14B Compounds (R=Pr, Nd, Gd, Dy), Journal of the Less-Common Metals, 1987, pp. 231-243, vol. 133, The Netherlands.
Rodewald, Magnetization and Aging of Sintered Nd-Fe-B Magnets, Journal of the Less-Common Metals, 1985, pp. 77-81, vol. 111, The Netherlands.
Machida, et al., Improved Magnetic Properties of Small-Sized Nd-Fe-B Magnets and Their Application for DC brush-less Micro-Motors, Center for Advanced Science and Innovation, Osaka University, May 2, 2005, pp. 25-30, Japan.
Herget, et al., Metallurgical Methods for the Production of Rare Earth-Transition Metal Permanent Magnet Materials, MPR Jun. 1987, pp. 438-444.
Japanese Office Action with a due date of Apr. 21, 2013 pertaining to JP Application No. 2011-245644.
Choi, et al., Improvement of the Magnetic Properties of Nd2Fe14B Powders by Dysprosium Diffusion, Rev. Adv. Mater. Sci, 28 (2011) pp. 134-140, 2011 Advanced Study Center Co. Ltd.

* cited by examiner

*Primary Examiner* — Jessee R. Roe
(74) *Attorney, Agent, or Firm* — Dinsmore & Shohl LLP

(57) ABSTRACT

A method of making a permanent magnet is described. In one embodiment, the method includes providing a first alloy powder having a desired composition, the alloy powder containing neodymium, iron, and boron; coating the first alloy powder with dysprosium, dysprosium alloy, terbium, or terbium alloy so that the first alloy powder has a surface concentration of dysprosium, terbium, or both in excess of a bulk concentration of dysprosium, terbium, or both; and forming the permanent magnet from the coated alloy powder using a powder metallurgy process, the permanent magnet having a non-uniform distribution of dysprosium, terbium, or both therein. Permanent magnets are also described.

20 Claims, 4 Drawing Sheets

METHOD OF MAKING ND-FE-B SINTERED MAGNETS WITH DY OR TB

BACKGROUND OF THE INVENTION

Permanent magnets find applications in a variety of devices, including electric motors for hybrid and electric vehicles. Sintered Nd—Fe—B permanent magnets have very good magnetic properties at low temperatures. After magnetization, permanent magnets are in a thermodynamically non-equilibrium state. Any changes in the external conditions, in particular the temperature, result in a transition to another, more stable state. These transitions are typically accompanied by changes in the magnetic properties. Due to the low Curie temperature of the $Nd_2Fe_{14}B$ phase, the magnetic remanence and intrinsic coercivity decrease rapidly with increased temperature.

It is important to improve the thermal stability of this material and to increase the magnetic properties further in order to obtain compact, lightweight, and powerful motors for hybrid and electrical vehicles. There are two common approaches to improving thermal stability and magnetic properties. One is to raise the Curie temperature by adding Co, which is completely soluble in the $Nd_2Fe_{14}B$ phase. However, the coercivity of the Nd—Fe—B magnets with Co decreases, possibly because of the nucleation sites for reverse domains. The second approach is to add heavy rare-earth (RE) elements. It is known that the substitution of dysprosium for neodymium or iron in Nd—Fe—B magnets results in increases of the anisotropic field and the intrinsic coercivity, and a decrease of the saturation magnetization (C. S. Herget, Metal, Poed. Rep. V. 42, P. 438 (1987); W. Rodewald, J. Less-Common Met., V111, P 77 (1985); and D. Plusa, J. J. Wystocki, Less-Common Met. V. 133, P. 231 (1987)). It is a common practice to add the heavy RE metals such as dysprosium (Dy) or terbium (Tb) into the mixed metals before melting and alloying.

However, Dy and Tb are very rare and expensive RE elements. Heavy REs contain only about 2-7% Dy. The price of Dy has increased sharply in recent times (from about $50/kg for DyO in 2005 to about $140/kg in 2010). Tb is needed if higher magnetic properties are required than Dy can provide, and it is much more expensive than Dy (about $400/kg for TbO).

Typical magnets for motors in hybrid vehicles contain about 6-10 wt. % Dy to meet the required magnetic properties. Conventional methods of making magnets with Dy or Tb result in the Dy or Tb being uniformly distributed within the magnet.

Assuming the weight of permanent magnet pieces is about 1-1.5 kg per electric motor, and a yield of the machined permanent magnet (PM) pieces of typically about 55-60%, 2-3 kg of PM per motor would be required, or 4-6 kg per vehicle (some hybrid vehicles may use one induction motor and one PM motor). Moreover, Dy is also widely used by other industries. The only RE mine in the United States does not have any significant amounts of Dy. Therefore, reducing the Dy or Tb usage in permanent magnets would have a very significant cost impact.

Nd—Fe—B permanent magnets can be produced using a powder metallurgy process, which involves melting and strip casting, hydrogen decrepitation (hydride and de-hydride), pulverizing (with nitrogen), screening, and mixing alloy powders for the desired chemical composition. A typical powder metallurgy process follows: weighing and pressing (vacuum bagging), isostatic pressing, sintering and aging (e.g., about 30 hrs, at about 1100 C, in vacuum), and machining to magnet pieces. Finally, the magnets are surface treated by phosphating, electroless Ni plating, epoxy coating, etc.

The ideal microstructure for sintered Nd—Fe—B based magnets is $Fe_{14}Nd_2B$ grains perfectly isolated by the nonferromagnetic Nd-rich phase (a eutectic matrix of mainly Nd plus some $Fe_4Nd_{1.1}B_4$ and Fe—Nd phases stabilized by impurities). The addition of Dy or Tb leads to the formation of quite different ternary intergranular phases based on Fe, Nd and Dy or Tb. These phases are located in the grain boundary region and at the surface of the $Fe_{14}Nd_2B$ grains. The addition of elements to improve the magnetic properties should desirably fulfill the following conditions: 1) the intermetallic phase should be nonferromagnetic to separate the ferromagnetic grains; 2) the intermetallic phase should have a lower melting point than the $Fe_{14}Nd_2B$ phase to produce a dense material via liquid phase sintering; and 3) the elements should have a low solubility in $Nd_2Fe_{14}B$ to keep good magnetic properties.

The microstructures of Nd—Fe—B sintered magnets have been extensively investigated in order to improve the magnetic properties. In general, sintered magnets are mainly composed of the hard-magnetic $Nd_2Fe_{14}B$ phase and a nonmagnetic Nd-rich phase. The coercivity is known to be greatly influenced by the morphology of the boundary phases between $Nd_2Fe_{14}B$ grains. The magnetic properties of the Nd—Fe—B sintered magnets are degraded when the magnet size is decreased because the machined surface causes nucleation of magnetic reversed domains. Machida et al. (Machida, K., Suzuki, S., Ishigaki, N., et al., Improved magnetic properties of small-sized magnets and their application for DC brush-less micro-motors. Coll. Abstr. Magn. Soc. Jpn. 142 (2005), 25-30), found that the degraded coercivity of small-sized Nd—Fe—B sintered magnets can be improved by surface treating of the formed magnet with Dy and Tb-metal vapor sorption so that there is a uniformly distributed coating of Dy or Tb on the outside of the formed magnet and no Dy or Tb inside.

SUMMARY OF THE INVENTION

One aspect of the invention is a method of making a permanent magnet. In one embodiment, the method includes providing a first alloy powder having a desired composition, the first alloy powder containing neodymium, iron, and boron; coating the first alloy powder with dysprosium, dysprosium alloy, terbium, or terbium alloy so that the first alloy powder has a surface concentration of dysprosium, terbium, or both in excess of a bulk concentration of dysprosium, terbium, or both; and forming the permanent magnet from the coated alloy powder using a powder metallurgy process, the permanent magnet having a non-uniform distribution of dysprosium, terbium, or both therein.

Another aspect of the invention is a permanent magnet. In one embodiment, the permanent magnet includes a neodymium, iron, and boron based magnet having a bulk concentration of dysprosium, or terbium, or both in a range of about 0.3 to about 5 wt % and a non-uniform distribution of dysprosium, terbium, or both therein.

DETAILED DESCRIPTION OF THE INVENTION

Figure 1:
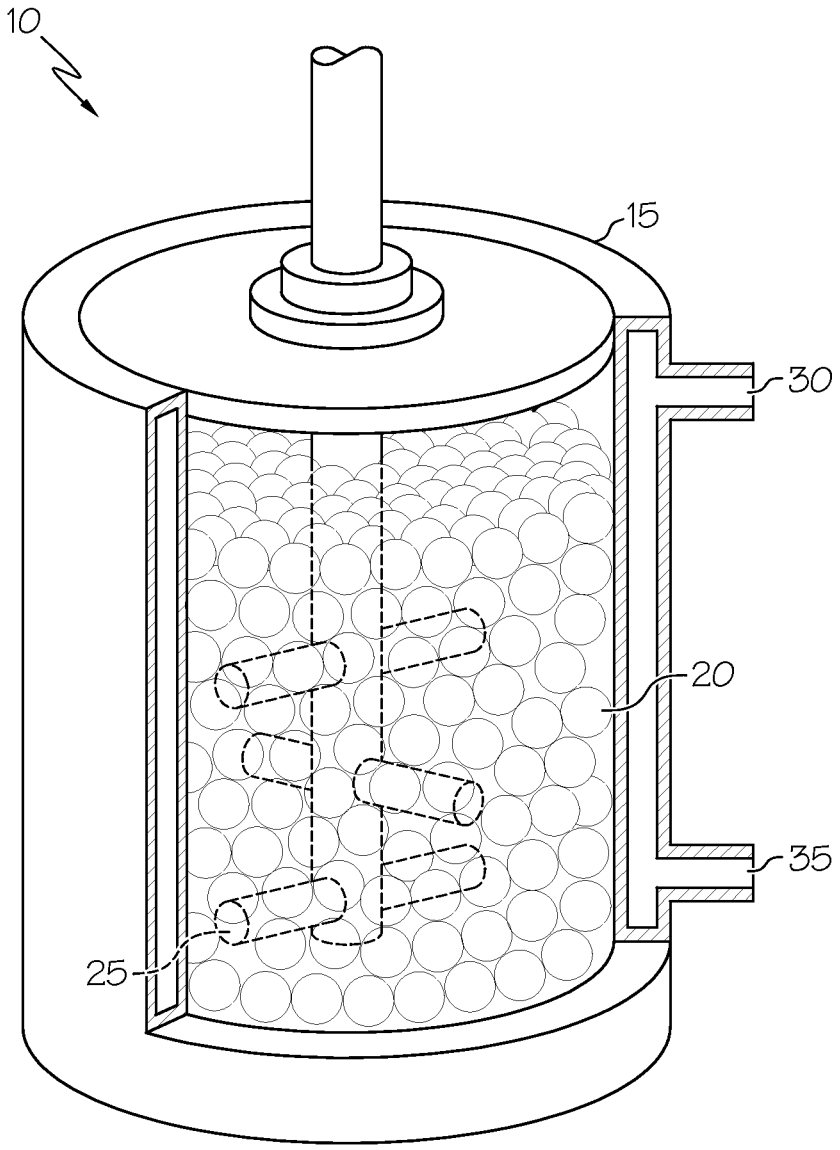
FIG. 1 is a schematic of a mechanical mill.

Magnets made using the present process use much less Dy or Tb than those made using the conventional methods while obtaining similar magnetic properties. In the present process, the Dy or Tb coated Nd—Fe—B powders are used to make the magnet, which results in a non-uniform distribution of Dy or Tb in the magnet, which can be seen and measured using a scanning electron microscope with a microprobe. This enables the present process to use much less Dy or Tb for the similar magnetic properties. For example, the amount of Dy and/or Tb can be reduced by about 20% or more compared to conventional processes, or about 30% or more, or about 40% or more, or about 50% or more, or about 60% or more, or about 70% or more, or about 80% or more, or about 90% or more. By non-uniform distribution, we mean that Dy and/or Tb are distributed or concentrated at the interface of the powder particles, with little or none inside the particles.

The process involves coating the Nd—Fe—B based powder used to make sintered Nd—Fe—B permanent magnets with Dy or Tb metals or alloys. The Nd—Fe—B based powder can be coated using a variety of coating methods. Suitable processes include, but are not limited to the following. One process involves mechanical milling with Dy or Tb metals or alloys. For example, Dy or Tb containing iron based alloy powder(s) (e.g., containing about 15-80 wt % Dy or Tb) is milled or mechanically alloyed with Nd—Fe—B based powder to create new powders with Dy or Tb enriched surfaces. Another process involves coating the Nd—Fe—B based powders with Dy or Tb metal vapor via physical vapor deposition (PVD). A third method involves coating the Nd—Fe—B based powders with very fine metal powder of Dy or Tb metal, or Fe—Dy or Fe—Tb alloy mixed with a solvent.

Using these methods, the coating thickness can be about one micrometer to about 100 micrometers, for example, about 2 to about 100 micrometers, or about 5 to about 90 micrometers, or about 5 to about 80 micrometers, or about 5 to about 70 micrometers, or about 5 to about 60 micrometers, or about 10 to about 50 micrometers.

The powder coating process allows the average Dy or Tb concentration to be reduced and changes the distribution of the Dy or Tb in the magnet. The average Dy or Tb concentration of the magnet can be in a range of about 0.3 to about 6 wt %, or about 0.3 to about 5 wt %, or about 0.3 to about 4 wt %, or about 0.3 to about 3 wt %, compared with about 6-9 wt % for traditional magnets having similar high magnetic properties. The coating process creates powder particles with a Dy or Tb surface concentration as high as about 5 to about 80 wt. % or more, and a low Dy or Tb bulk concentration (i.e., inside the particles). Dy and/or Tb could be intentionally added or partially diffused into the powder particle from the particle surface, if desired. However, the bulk concentration of Dy and/or Tb inside the particles is less than the surface concentration of Dy and/or Tb. The coating process is introduced into the current preparation for the powder metallurgy process as an extra step.

Dy or Tb or both can be used, as desired. If Tb is included, not as much Dy is needed. For example, the combination of Dy and Tb could be less than about 6 wt %. Tb can be much more effective than Dy in improving magnetic properties. However, this should be balanced against the significantly higher cost of Tb. A ratio of Dy:Tb of up to about 1:5 can be used if desired, but a ratio of up to about 1:3 would be more typical due to cost considerations.

The Dy or Tb concentration distribution feature can be manipulated by various heat treatments of the magnets, especially annealing schedules. A longer time or higher temperature can make the distribution wider and less concentrated at the particle surface.

The magnet manufacturing process includes: 1) melting and strip casting, 2) hydrogen decrepitation (hydride and de-hydride), 3) pulverizing (with nitrogen), 4) mixing alloy powder to adjust the chemical composition and optional screening, 5) coating the powder with Dy and/or Tb rich powder, and 6) optional screening. This is followed by a typical powder metallurgy process, such as: weighing and pressing (vacuum bagging), isostatic pressing, sintering and aging (e.g., about 30 hrs, at about 1100° C., in vacuum) and machining to magnet pieces. Finally, the magnets are surface treated (e.g., phosphate, electroless Ni plating, epoxy coating, etc.).

The three coating methods described above will be discussed in more detail.

Mechanical alloying is a solid-state powder processing technique involving repeated welding, fracturing, and rewelding of powder particles in a high-energy ball mill. It can be used to synthesize a variety of equilibrium and non-equilibrium alloy phases starting from blended elemental or pre-alloyed powders. The non-equilibrium phases synthesized include supersaturated solid solutions, metastable crystalline and quasicrystalline phases, nanostructures, and amorphous alloys.

Mechanical alloying uses a high energy mill to favor plastic deformation required for cold welding and to reduce the process times. It allows a mixture of elemental and master alloy powders to be used. The use of master alloy powders reduces the activity of the element because it is known that the activity in an alloy or a compound could be orders of magnitude less than in a pure metal. Mechanical alloying eliminates the use of surface-active agents which would produce fine pyrophoric powder as well as contaminate the powder. It relies on a constant interplay between welding and fracturing to yield a powder with a refined internal structure, typical of very fine powders normally produced, but which has an overall particle size which is relatively coarse, and therefore stable.

The mechanical alloying process starts with mixing the powders in the desired proportion. The powder mix is loaded into the ball mill along with the grinding medium (e.g., steel balls). The powder mixture is then milled for the desired length of time. The important components of the mechanical alloying process are the raw materials, the mill, and the process variables. Parameters include the type of mill, the milling container, milling speed (generally about 50 to about 400 rpm, typically about 250 rpm), milling time (generally about 0.5 to about 12 hours), the type, size, and size distribution of the grinding medium (e.g., hardened steel, stainless steel etc.), ball-to-powder weight ratio (generally about 1:1 to as high as about 220:1, with about 10:1 being typical), the extent of filling the vial, the milling atmosphere (e.g., vacuum, nitrogen, or argon), and temperature of milling (generally room temperature to about 250° C.).

The raw materials used for mechanical alloying can have particle sizes in the range of 1-200 μm. The powder particle size is not critical, except that it should be smaller than the grinding ball size, because the powder particle size decreases exponentially with time and reaches a few microns after only a few minutes of milling. The raw powders can be pure metals, master alloys, or pre-alloyed powders.

Different types of high-energy milling equipment can be used to produce mechanically alloyed powders. They differ in their capacity, efficiency of milling, and additional arrangements for cooling, heating, etc. A conventional ball mill 10 includes a rotating horizontal drum 15 partially filled with small steel balls 20, as shown in FIG. 1. As the drum 15 rotates, the balls 20 drop on the metal powder that is being ground. The grinding tanks or containers are available in stainless steel or stainless steel coated inside with alumina, silicon carbide, silicon nitride, etc., for example. The ball mill 10 includes a rotating impeller 25. Coolant flows through the jacket of the drum 15 from an inlet 30 to an outlet 35 to control the temperature of the powder during milling.

Figure 2:
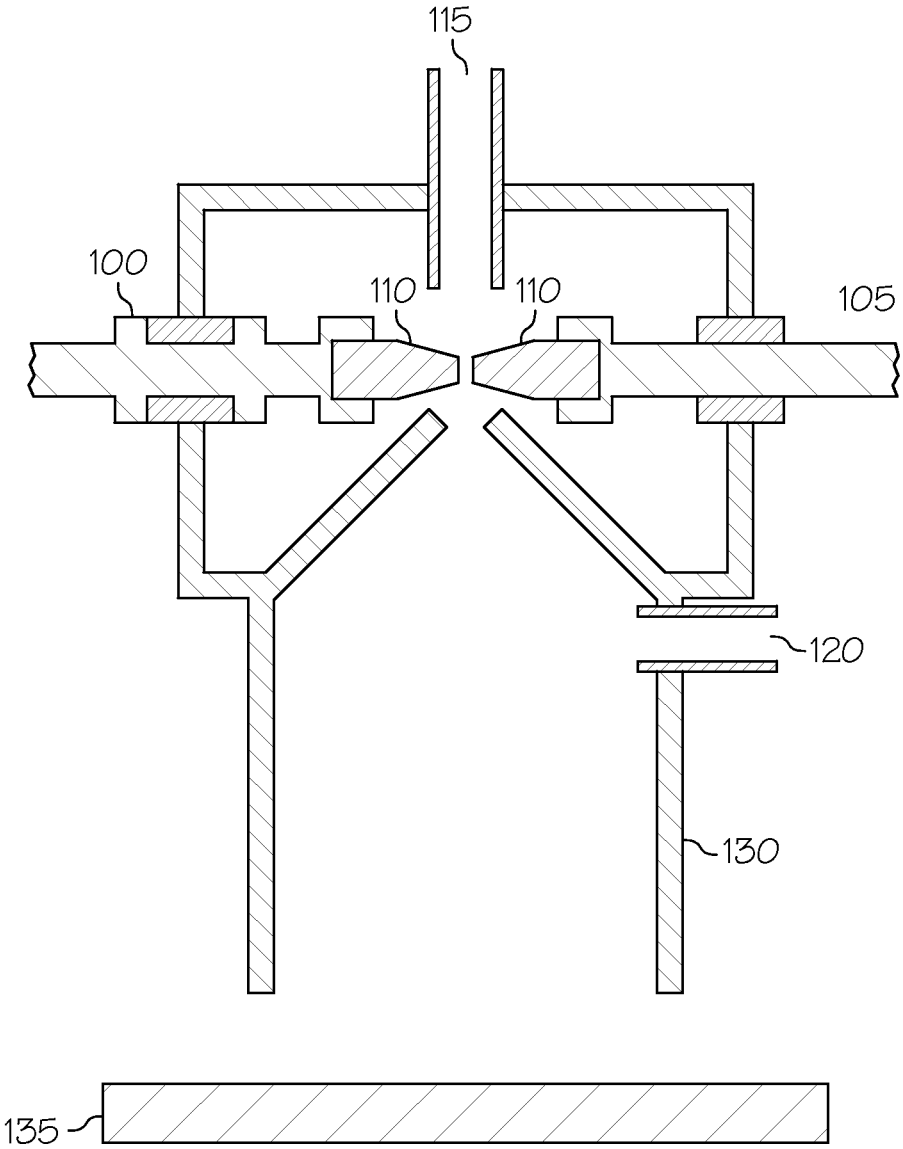
FIG. 2 is a schematic of a particle gun based on spark erosion.
Figure 3:
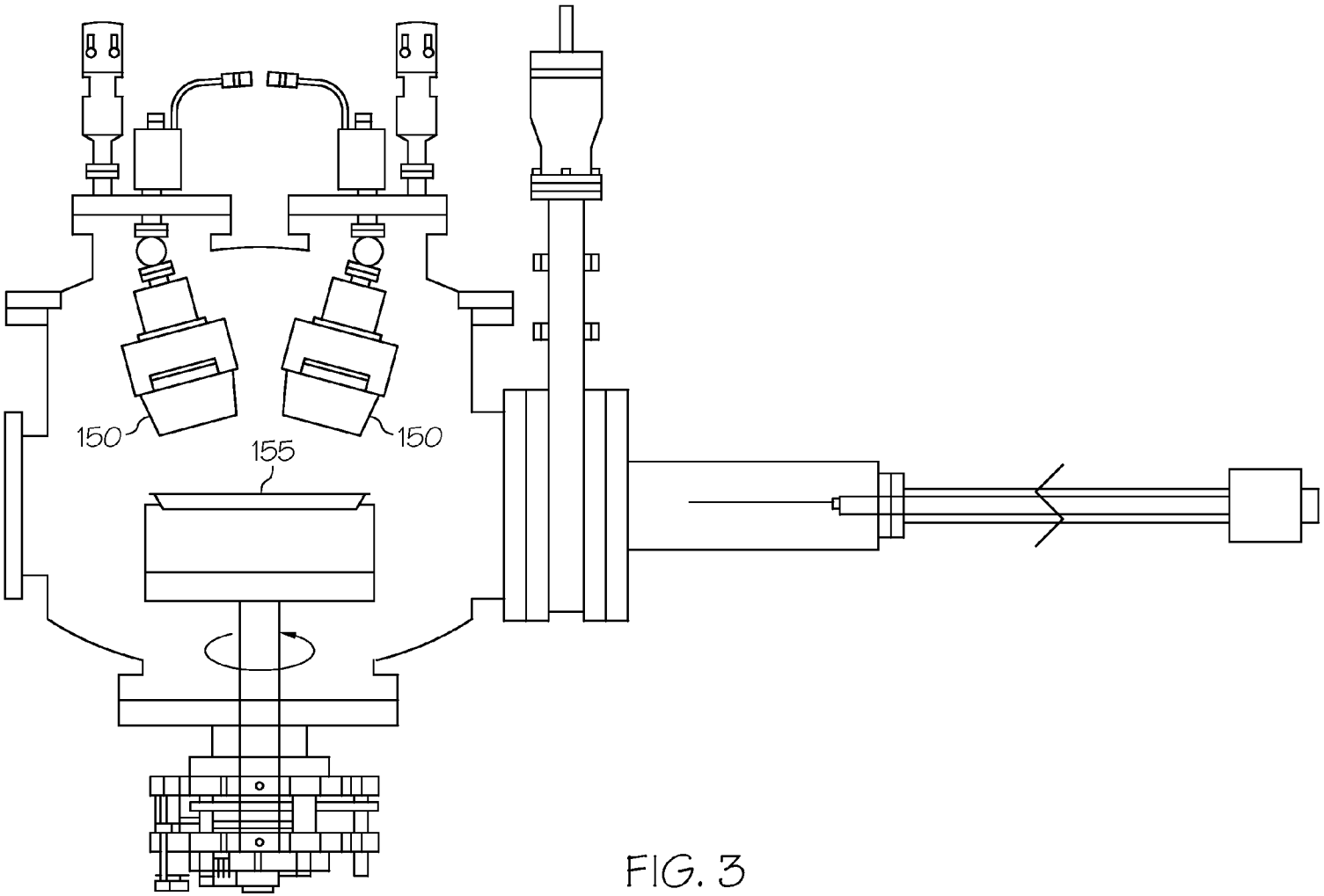
FIG. 3 is a schematic of a particle gun based on high pressure sputtering.

Another method involves coating the Nd—Fe—B based powders with Dy or Tb metal using physical vapor deposition (PVD). PVD methods using a particle gun based on spark erosion and sputtering are illustrated in FIGS. 2-3, although other PVD processes could be used if desired. The "substrate" can be located on the bottom. The substrate is basically a container containing the Nd—Fe—B powders to be coated. If desired, there can be a mixer (not shown) in the container to stir the powders to ensure a uniform coating on the powders.

FIG. 2 illustrates a spark erosion PVD process. There is a fixed electrode holder 100 and an moveable electrode holder 105. The fixed electrode holder 100 is connected to an electrical power supply (not shown). The moveable electrode holder 105 is connected to an electrical power supply and a mechanical oscillator (not shown). The fixed electrode holder 100 and moveable electrode holder 105 have electrodes 110. A carrier gas inlet 115 introduces a carrier gas. A treatment gas inlet 120 introduces a treatment gas into the carrier gas. The coating material is directed to the substrate 135.

A sputtering PVD coating process is shown in FIG. 3. There are two magnetron sputter sources 150 on the top directed toward the rotating substrate table 155 on the bottom. In sputtering, atoms are ejected from the surface of a target material (Dy and/or Tb or the alloys) due to the impact of high energy particles (such as nitrogen ions) in plasma. The ejected atoms condense on the surface of the substrate creating a thin film.

The third coating method involves coating the Nd—Fe—B based powders with a very fine metal powder of Dy or Tb metal and/or alloys mixed with a solvent. A high velocity jet (about 30 to about 60 ft/sec) is established by accelerating a stream of air or inert gas with a swirl accelerator. By adjusting the flow rate and pressure of the air/gas stream, a laminar flow pattern can be established at Reynolds numbers where turbulent flow would normally occur. The gas is directed to a "coating tube". The swirl accelerator is available from GEA Process Engineering Inc., of Columbia, Md. 21045, for example.

Figure 4:
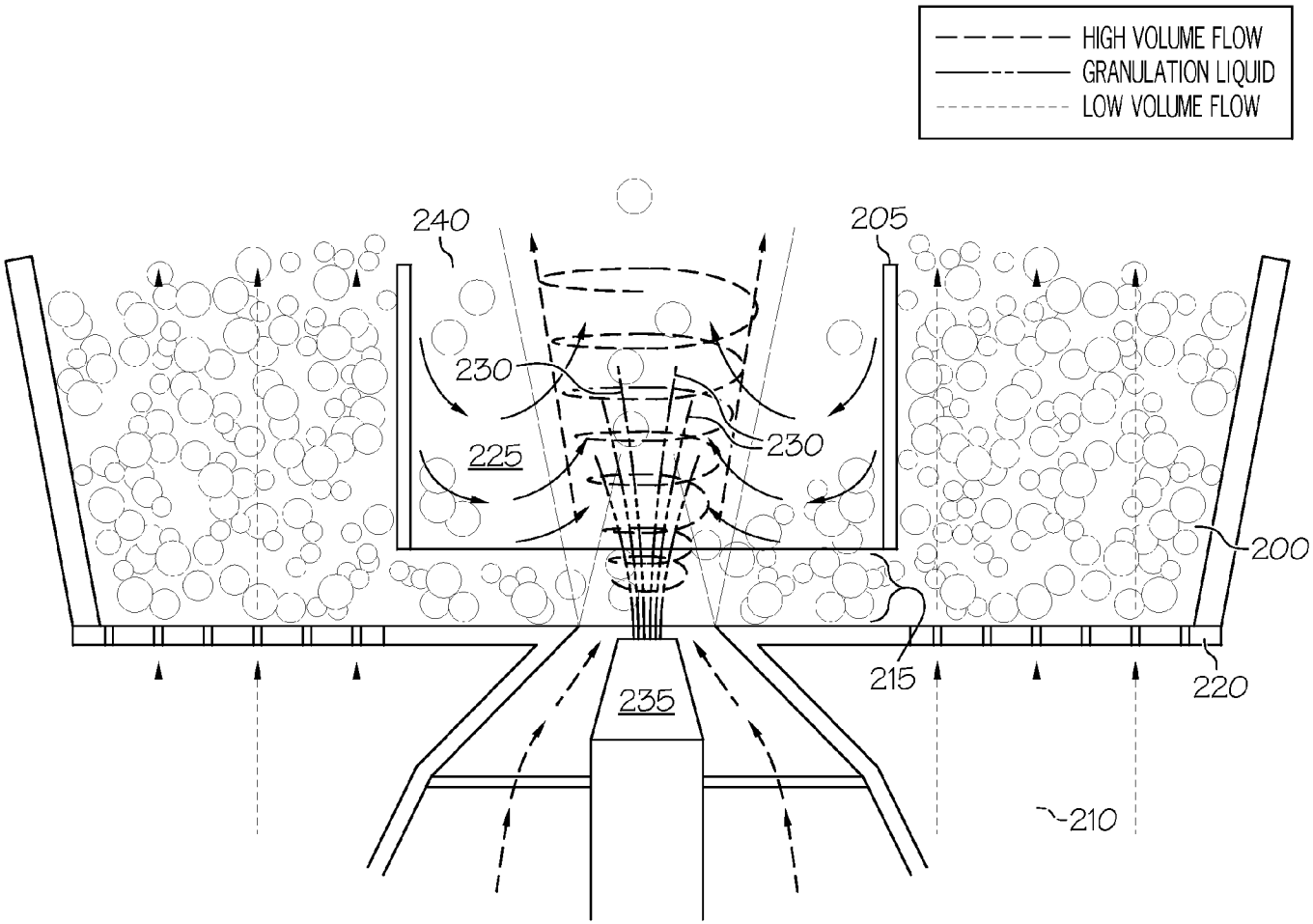
FIG. 4 is a schematic of a swirl coater.

As shown in FIG. 4, a reservoir of the powder to be coated in the area of "down flow bed" 200 surrounds the coating tube 205 and is kept lightly aerated by a low velocity gas stream 210 that enters the powder bed from the bottom. There is a low volume flow in this area. A gap 215 between the inlet fluidizing plate 220 and the bottom of the coating tube 205 under the wetting and contacting zone 225 allows powder to be exposed to the high velocity gas stream. Particles of powder are picked up at this interface and accelerated by the gas stream.

A fine spray 230 of the coating that contains Dy or Tb metal or alloy is introduced into the bottom of the high velocity gas stream through the spray nozzle 235. The coating spray 230 is moving faster than the solid particles so contact occurs and a coating is deposited.

The boundary layer effect causes a velocity gradient from high gas velocity at the center of the tube to zero at the wall. This gradient causes the powder to be tumbled by the gas stream so that all particle surfaces are exposed to the coating spray. Once the coating is applied, the coated particle travels on up the coating tube. The particle velocity is always lower than the gas velocity so there is always a movement of gas across the particle surface. This gas movement evaporates the solvent and dries the coating in the drying zone 240. The particle is substantially dry by the time it reaches the end of the coating tube 205.

At the end of the tube, the particles disengage from the high velocity stream and fall back to the holding area (not shown).

The "solvent" or carrier can be alcohols, chlorinated solvents, or almost any other solvent used industrially. The actual coating time is extremely short so that only a thin layer of coating is applied with each coating. The Nd—Fe—B powders are repeatedly coated to obtain a desired coating thickness. The final coating thickness is generally a few micrometers or less, e.g., less than about 10 micrometers, or about 1 to about 10 micrometers, or about 2 to about 5 micrometers, depending on the process parameters. The typical conveying velocity is about 20 to about 40 meter/sec. At any given time, most of the powder in the system is dry because the actual wetting and drying process is very short, making the process relatively easy to control. The rapid coating and drying cycle also means that the powder is only wetted by the solvent for a very short time. The solvent has little opportunity to penetrate the interior of the particles. This means that solvent/powder reactions are generally not a problem, and it is often possible to use solvents that would normally be considered incompatible with the powder.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. For example, a "device" according to the present invention may comprise an electrochemical conversion assembly or fuel cell, a vehicle incorporating an electrochemical conversion assembly according to the present invention, etc.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of making a permanent magnet comprising:

providing a first alloy powder having a desired composition, the first alloy powder containing neodymium, iron, and boron;

coating the first alloy powder with dysprosium, dysprosium alloy, terbium, or terbium alloy so that the first alloy powder has a surface concentration of dysprosium or terbium, in excess of a bulk concentration of dysprosium or terbium;

screening the first alloy powder before coating the first alloy powder; and forming the permanent magnet from the coated alloy powder using a powder metallurgy process, the permanent magnet having a non-uniform distribution of dysprosium, terbium, or both therein.

2. The method of claim 1 wherein providing the first alloy powder comprises:

melting and strip casting an alloy containing neodymium, iron, and boron to make strips;

hydrogen decrepitating the strips;

pulverizing the decrepitated strips to make a starting powder;

mixing the starting powder with a second alloy powder to form the first alloy powder.

3. The method of claim 1 wherein forming the magnet from the coated alloy powder using a powder metallurgy process comprises:

pressing the coated alloy powder;

isostatic pressing the pressed coated alloy powder; and sintering and aging the isostatic pressed powder to form the permanent magnet.

4. The method of claim 3 further comprising machining the permanent magnet.

5. The method of claim 1 wherein the surface concentration of the coated alloy powder is in a range of about 5 to about 80 wt % dysprosium or terbium.

6. The method of claim 1 wherein the average concentration of a magnet is in a range of about 0.3 to about 6.0 wt % dysprosium or terbium.

7. The method of claim 1 wherein the coating on the first alloy powder has a thickness of less than about 100 micrometers.

8. The method of claim 1 wherein coating the first alloy powder with dysprosium, dysprosium alloy, terbium, or terbium alloy comprises mechanical milling the first alloy powder with dysprosium, dysprosium alloy, terbium, or terbium alloy.

9. The method of claim 1 wherein coating the first alloy powder with dysprosium, dysprosium alloy, terbium, or terbium alloy comprises depositing dysprosium, dysprosium alloy, terbium, or terbium alloy using a physical vapor deposition process.

10. The method of claim 9 wherein the physical vapor deposition process is a spark erosion physical vapor deposition process, or a sputtering physical vapor deposition process.

11. The method of claim 1 wherein coating the first alloy powder with dysprosium, dysprosium alloy, terbium, or terbium alloy comprises coating the alloy powder with dysprosium, dysprosium alloy, terbium, or terbium alloy mixed with a carrier.

12. The method of claim 11 wherein the first alloy powder is coated using a swirl accelerator.

13. The method of claim 1 further comprising heat treating the permanent magnet to change the non-uniform distribution of dysprosium or terbium.

14. A method of making a permanent magnet comprising:

melting and strip casting an alloy containing neodymium, iron, and boron to make strips;

hydrogen decrepitating the strips;

pulverizing the decrepitated strips to make a starting powder;

mixing the starting powder with a second alloy powder to form a first alloy powder having a desired composition, the first alloy powder containing neodymium, iron, and boron;

coating the first alloy powder with dysprosium, dysprosium alloy, terbium, or terbium alloy so that the first alloy powder has a surface concentration of dysprosium or terbium in excess of a bulk concentration of dysprosium or terbium;

forming the permanent magnet from the coated alloy powder using a powder metallurgy process, the permanent magnet having a non-uniform distribution of dysprosium or terbium therein.

15. The method of claim 14 wherein forming the magnet from the coated alloy powder using a powder metallurgy process comprises:

pressing the coated alloy powder;

isostatic pressing the pressed coated alloy powder;

sintering and aging the isostatic pressed powder to form the permanent magnet; and machining the permanent magnet.

16. The method of claim 14 wherein coating the first alloy powder with dysprosium, dysprosium alloy, terbium, or terbium alloy comprises mechanical milling the first alloy powder with dysprosium, dysprosium alloy, terbium, or terbium alloy.

17. The method of claim 14 wherein coating the first alloy powder with dysprosium, dysprosium alloy, terbium, or terbium alloy comprises depositing dysprosium, dysprosium alloy, terbium, or terbium alloy using a physical vapor deposition process.

18. The method of claim 17 wherein the physical vapor deposition process is a spark erosion physical vapor deposition process, or a sputtering physical vapor deposition process.

19. The method of claim 14 wherein coating the first alloy powder with dysprosium, dysprosium alloy, terbium, or terbium alloy comprises coating the first alloy powder with dysprosium, dysprosium alloy, terbium, or terbium alloy mixed with a carrier using a swirl accelerator.

20. The method of claim 14 further comprising heat treating the permanent magnet to change the non-uniform distribution of dysprosium or terbium.

* * * * *